US005984666A

United States Patent [19]

Pillard et al.

[11] Patent Number: 5,984,666

[45] Date of Patent: Nov. 16, 1999

[54] DEVICE FOR MOUNTING BURNERS IN A DUCT FOR GAS TO BE HEATED

[75] Inventors: Jean Claude Pillard, Marseille; Jacques Pizant, Allauch, both of France

[73] Assignee: Entreprise Générale de Chauffage Industrial Pillard, Marseille Cedex, France

[21] Appl. No.: 09/032,717

[22] Filed: Feb. 27, 1998

[30] Foreign Application Priority Data

Feb. 27, 1997 [FR] France ..... 9 /02586

[51] Int. Cl.[6] ..... F23D 11/36

[52] U.S. Cl. ..... 431/154; 431/186; 431/189; 239/140; 239/587.1

[58] Field of Search ..... 431/154, 155, 431/186, 189, 181, 153, 159; 239/125, 140, 195, 271, 537, 541, 587.1, 587.2

[56] References Cited

U.S. PATENT DOCUMENTS

| | | | |
|---|---|---|---|
| 1,215,653 | 2/1917 | Hale | 126/39 R |
| 2,512,319 | 6/1950 | Ferguson | 431/189 |
| 2,728,649 | 12/1955 | Kowenstrot et al. | 239/200 |
| 3,169,573 | 2/1965 | Hidaka | 239/587.1 |
| 3,209,810 | 10/1965 | Schuvart | 431/154 |
| 3,498,323 | 3/1970 | Rahm | 431/154 |
| 4,082,499 | 4/1978 | Rossi | 431/189 |
| 4,116,617 | 9/1978 | Backman et al. | 431/155 |
| 4,479,612 | 10/1984 | Umbach et al. | 239/587.1 |
| 5,087,194 | 2/1992 | Viessmann | 431/154 |

*Primary Examiner*—Ira S. Lazarus
*Assistant Examiner*—Josiah Cocks
*Attorney, Agent, or Firm*—Dvorak & Orum

[57] ABSTRACT

A device for mounting burners inside a duct for gas and comprising at least one fuel injection pipe having a nose disposed in the head of said burner on an axis parallel to the axis of the duct. The injection pipe is situated inside a sheath secured to the burner head for feeding it with air from outside the duct and disposed transversely relative to the axis of the duct, and the nose of the injection pipe, situated at the end of a bent portion of the pipe, is movable along the axis relative to a guide orifice secured to the burner head, from which it is suitable for being disengaged by the injection pipe being moved inside the sheath from outside the duct, thereby making it possible, from outside the duct, to extract the injection pipe completely to the outside of the duct.

9 Claims, 4 Drawing Sheets

DEVICE FOR MOUNTING BURNERS IN A DUCT FOR GAS TO BE HEATED

The present invention relates to a device for mounting burners inside a gas duct in which the gas flows, requiring burners suitable for operating in atmospheres that contain little oxygen.

FIELD OF THE INVENTION

The technical field of the invention is that of manufacturing and mounting combustion apparatus using liquid and/or gaseous fuels.

BACKGROUND OF THE INVENTION

One of the main applications of the invention is mounting burners in ducts that exhaust postcombustion gases downstream from gas turbines and upstream from recuperator boilers in a cogeneration unit: such burners enable the temperature of turbine gases to be raised up to 1800° C., for example, thereby increasing the efficiency of said boilers. In addition, they make it possible to operate said boilers with fresh oxidizing air when the turbines are not in operation.

Other applications are also possible for heating gas ducts, in particular those having a low oxygen content, such as installations for heating flue gases. . . .

At present there exist four types of burner corresponding to the above applications; i.e. the following, listed by type of structure:

strip burners which use only gas as the sole fuel and which are disposed in fixed manner inside said duct for the gas to be heated;

gas and light fuel oil strip burners comprising fixed gas burner strips as before disposed between burner heads for light fuel oil, such as those described in patent application FR 2 285 574; together, the strips and the heads constitute a single assembly and they do not enable heavy fuel oil to be used since it cannot be distributed uniformly between the various heads, since it is practically impossible to balance the heavy fuel oil flow rate accurately without metering because of the risk of solidification, because of the differences of headloss as a function of feed line length and because of the differences in burner height; that is why heavy fuel oil burners generally make use of a single central injection pipe;

lateral or external burners having a flame axis that is perpendicular or inclined relative to the flow direction of the gas to be heated, i.e. to the main flow axis of the duct. This disposition makes it possible to place the burner(s) outside the duct, providing an intersecting axis flame is given protection, or to place it in a housing that is completely outside the duct, in which case the burner does not heat the gas directly but acts as a hot gas generator, or by placing the flame inside the duct and protecting it by a kind of internal deflector to keep the gases that are to be heated away from the transverse flame so as to prevent the flame being excessively disturbed and so as to avoid producing too large a quantity of unburned fuel. Nevertheless, that disposition suffers from numerous drawbacks, in particular: it is difficult to match the size of the flame or flames exactly to the size of the duct; the recuperation boiler situated downstream from the burner(s) does not recover radiation from the flames, thus giving rise to a loss of efficiency and requiring overdimensioning; the transverse flames are always disturbed to some extent by the flow of gases to be heated which have a low oxygen content thus giving rise to unburned fuel; and the sides of the duct can be damaged by the proximity of flame ends; and burners that can be referred to as "in-duct" burners since they are located entirely inside a gas flow duct; this is the type of installation used for the burners of the present invention, and it has a burner flow axis parallel to the flow axis inside the duct; the number of burners installed in this way is small, and is generally always equal to or less than six, and is even preferably two; the burners are fed with liquid or gaseous fuels by pipes connected to the side of the duct. Compared with the burners in the first two types of structure mentioned above, these burners provide far more options since they can use any type of fuel equally well, regardless of whether the fuel is liquid, light, heavy, or gaseous, and secondly they give combustion results that are better than those of the third above-described structure because the burners are positioned much more logically on the axis and near the center of the duct; however, unlike lateral or external burners, but like the burners in the first two structures described, they are very difficult of access, and in order to dismount them, modify them, or repair them it is necessary to enter into the duct. This is not too inconvenient for gas-only strip burners or even for light fuel oil burners since the risks of having to perform adjustments and maintenance operations on such strips are much lower than when using heavy fuel oil. However, the use of special gases, such as hydrogenated gases, or gases that entrain liquid particles such as refinery gases, makes it necessary to be able to have access likewise for dismounting and maintenance of gas injectors.

Unfortunately, the ducts in which the gases that are to be heated or reheated flow are several meters wide and tall, commonly about 6 meters (m), and given that turbine exhaust gases are already at about 500° C. or more, in order to be able to act on such burner heads it is necessary to stop the flow of hot air and wait for the equipment to cool down before it is possible to penetrate inside the duct to access said burners.

OBJECT AND BRIEF SUMMARY OF THE INVENTION

The problem posed is thus to be able to take action on burner heads including at least one liquid fuel injection pipe, possibly together with gas injection pipes, placed on a common axis inside ducts in which there flows a gas to be heated or reheated, so as to be able to repair, modify, or merely clean said injection pipes, and to do so without needing to stop said circulation of gas in said duct for too long.

A solution to the problem posed is a device for mounting such a burner inside a duct for gas and comprising at least one fuel injection pipe having a nose disposed in the head of said burner on an axis parallel to the axis of said duct; according to the invention said injection pipe is situated inside a sheath secured to the burner head for feeding it with air from outside the duct and disposed transversely relative to the axis of said duct; and said nose of the injection pipe, situated at the end of a bent portion thereof, is movable along said axis of the burner relative to a guide orifice secured to said burner head, from which it is suitable for being disengaged by the injection pipe being moved inside the sheath from outside the duct, thereby making it possible, from outside the duct, to extract the injection pipe completely to the outside.

In a preferred embodiment, the assembly comprising the burner head and its air feed sheath is also extractable transversely out from the duct while acting from the outside thereof, by means in particular of at least one hollow post that is vertical or inclined and preferably by less than 45° relative to the vertical; the post is disposed inside said duct, suspended at its top and supporting horizontal running paths on which there are placed means for engaging and guiding said burner head; said hollow vertical or inclined support post is thus cooled by the flow of air inside its own volume by a natural draft effect or by forced ventilation.

In a preferred embodiment, the device of the invention also includes at least two flaps disposed on either side of the burner head, to tilt about axes that are transverse to said duct, and of shapes compatible with the inside shape of the duct and the outside shape of the burner head, serving in a closed position to reduce the gas flow section at least through the flow section of the burner head; said flaps and their axes are preferably likewise hollow and connected to a hollow vertical or inclined duct such as the hollow vertical or inclined support post supporting said burner heads, in order likewise to provide cooling by an internal flow of air driven by a natural draft effect or by ventilation.

Such flaps make it possible to reduce the flow section of the gases to be heated, in particular when dealing with fresh oxidizing air instead of postcombustion gases from gas turbines when they are not in operation, for example.

The result is novel devices for mounting "in-duct" burners located inside a gas duct for gases such as the exhaust gases from gas turbines: such devices satisfy the problem posed without the drawbacks of presently known burners, since firstly they make it possible, from outside the duct, to extract the liquid fuel injection pipe(s) without having to remove the entire burner, and thus practically without interrupting the flow of gas to be heated, and secondly they enable the entire burner head assembly itself to be extracted quite quickly without having to wait for the duct to cool down; this limits the down time of installations, particularly cogeneration installations using gas turbine postcombustion for which production losses increase with increasing down time; in the present invention down time is reduced to the strict minimum by making such burners easily accessible and dismountable which is of very great advantage in developing such units in all industries.

In addition, the present invention can be adapted to all the types of burner described by way of embodiments in the following figures; the design of such burners is based on that described in patent FR 2 570 473 filed in 1984 by the same Applicant as the present invention, EGCI PILLARD, and describing parallel flow gas burners including a rose and flame capture means.

BRIEF DESCRIPTION OF THE DRAWINGS

Other advantages of the present invention could be mentioned but those mentioned above already suffice to demonstrate the novelty and the advantage thereof. The following description and figures thus show an embodiment of the invention without any limiting character: other embodiments are possible in the ambit of the scope of the extent of this invention, in particular by changing the type of burner, as mentioned above.

MORE DETAILED DESCRIPTION

Figure 1:
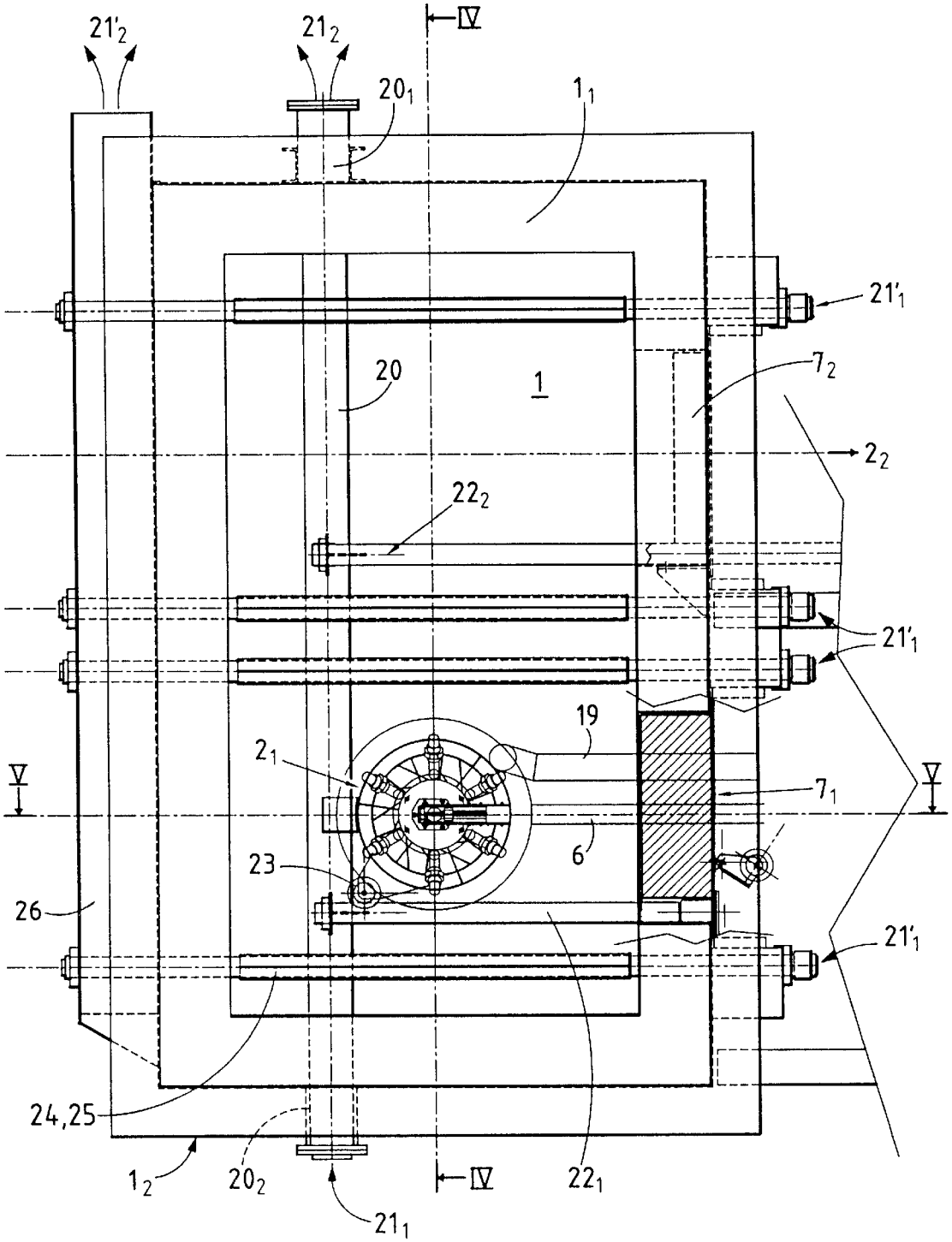
FIG. 1 is a cross-section view of a gas flow duct in which a burner is located that is mounted using the device of the present invention.
Figure 4:
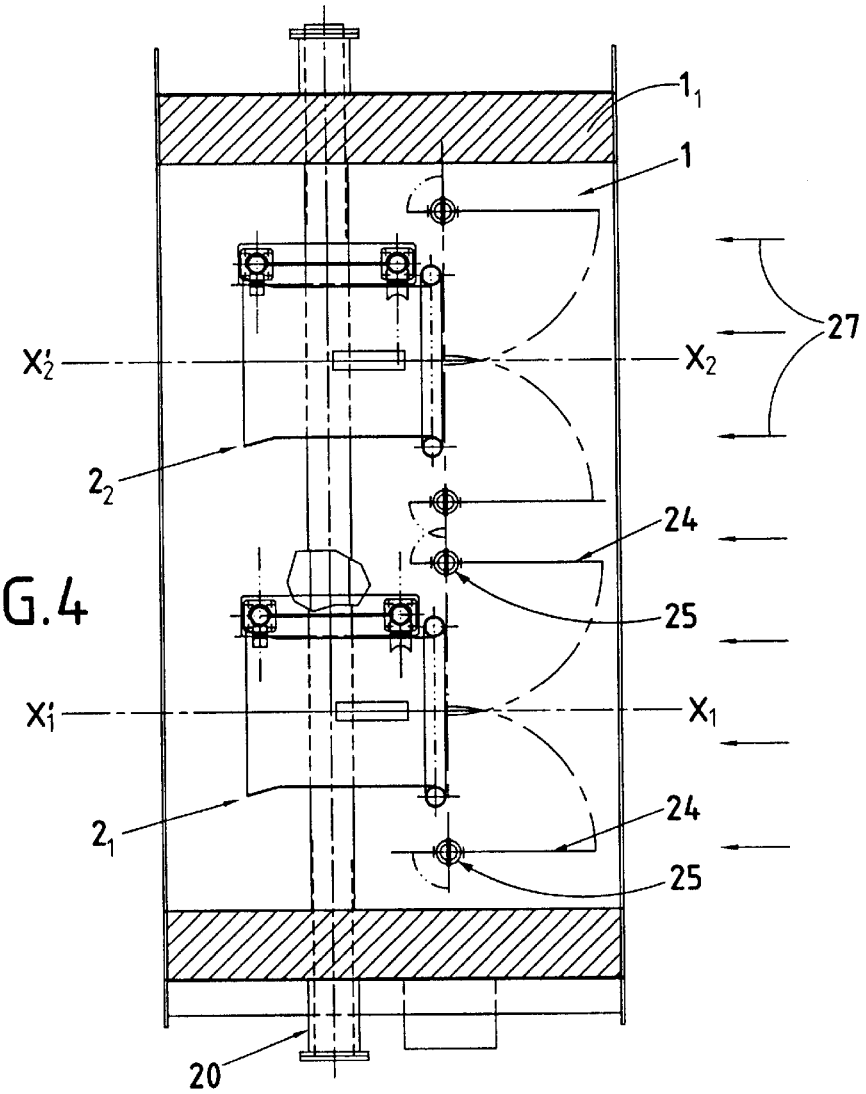
FIG. 4 is a view in section on IV–IV' through the gas duct of FIG. 1.
Figure 5:
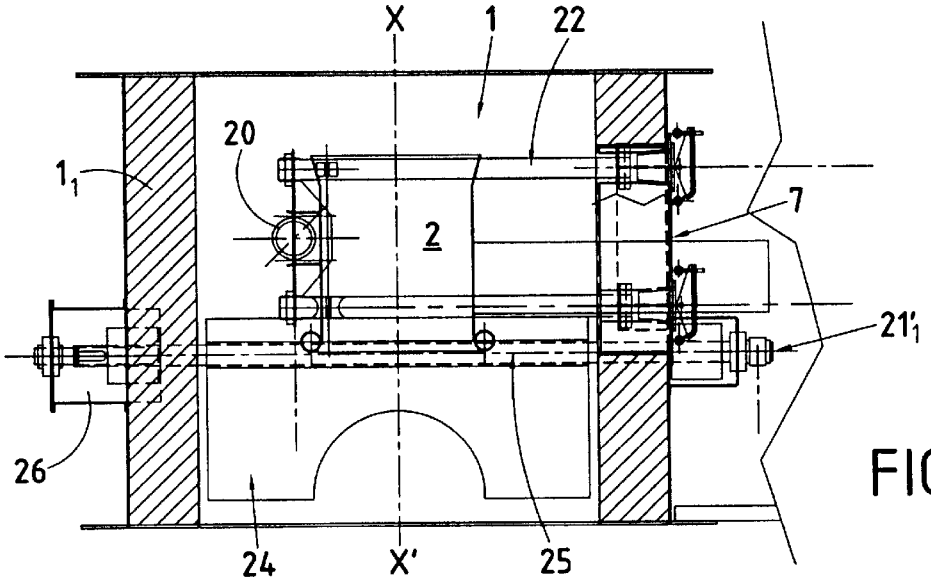
FIG. 5 is a section view on V–V' through the same gas duct of FIG. 1.

FIGS. 4 and 5 show a length of the duct 1 for a gas 27 that flows therealong, which length of duct is naturally connected via inlet and outlet faces to ducting that may be connected upstream to a gas turbine and downstream to a recuperation boiler; FIG. 1 is a view from the upstream end with a burner head $\mathbf{2}_1$ in its operating position inside the duct 1 and with a second head $\mathbf{2}_2$ that is not shown since it has been completely extracted from the duct and a trap door $\mathbf{7}_2$ or guillotine put in place to close the through section via which said head $\mathbf{2}_2$ is extracted, thereby enabling the installation to continue operating without the burner $\mathbf{2}_2$.

The means for handling and extracting said heads are not shown in the various figures since they can be implemented by a person skilled in the art without it being necessary to describe them in the context of the present invention.

To make it possible, from outside the duct 1, to extract the assembly comprising the burner head 2 and its sheath 6 for feeding it with outside air completely from the duct 1, as described below, a vertical or inclined hollow post 20 is disposed inside the duct and it is suspended from the top: the vertical post 20 is free to expand downwards, passing through the bottom portion of the duct 1 via packing $\mathbf{20}_2$ that is leakproof against the hot gases, thereby leaving the said post 20 free to expand, which post may be internally cooled and isolated by a flow of outside air $\mathbf{21}_1$ driven by a natural draft or by forced ventilation.

Said vertical post $\mathbf{20}_1$ supports horizontal running paths 22 on which engagement and guide means 23 are placed such as one or more wheels located in the bottom portion of said burner head 2 and of a shape that corresponds to and co-operates with the shape of the selected running paths 22. The paths may press against and be held by plates that are secured to the post 20 while still being free to expand longitudinally relative to said plates; optionally the running paths, of which there are preferably two, can also be constituted by hollow support tubes that, like the support post 20, are insulated and cooled by an internal flow of air.

The assembly comprising the burner head 2 and its means for moving it for extraction purposes, together with the set of pipes 6 and 19 connecting it to the outside is secured to a closure hatch $\mathbf{7}_1$ shown in FIG. 1 and serving to ensure continuity of the duct 1 and of its insulation $\mathbf{1}_1$.

In conventional manner, the burners used comprise at least one fuel injection pipe 3 having its nose 5 disposed in the head 2 of said burner on an axis XX' parallel to the axis of said duct 1: in accordance with the invention, said injection pipe 3 is situated inside a sheath 6 for feeding the burner head 2 to which it is secured with air from outside the duct 1; said sheath is disposed on an axis YY' extending transversely to the axis of the duct 1; and said nose 5 of the injection pipe 3, situated at the end of a bent portion 4 thereof, is movable along the axis XX' relative to a guide orifice 14 secured to said burner head 2, from which it can be disengaged by moving the injection pipe 3 from outside the duct 1, and inside the sheath 6.

Figure 3:
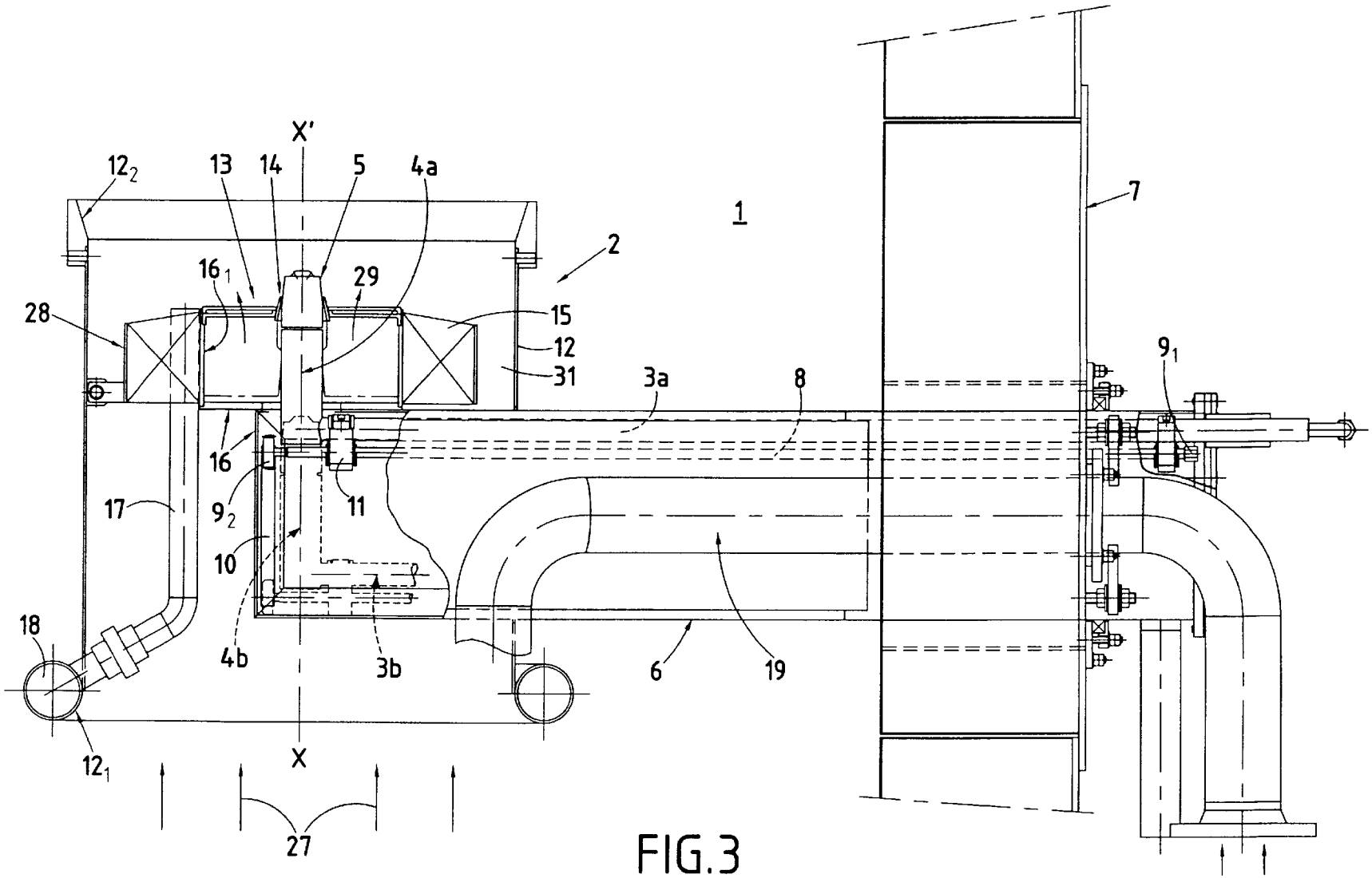
FIG. 3 is a plan view in partial section of the FIG. 2 burner.

In order to make it possible to move and extract the injection pipe 3 towards or away from the outside of the duct, as shown in FIGS. 3 and 4, the injection pipe is associated, for example, with a rotary shaft 8 driven from outside the duct 1, situated inside the sheath 6 parallel to the injection pipe 3, and carrying a gear $\mathbf{9}_2$, at least at its distal end, to co-operate with a rack 10; since the rack is situated at the burner head end 16 of the sheath 6, when the drive shaft 8 rotates said gear 9 it causes the gear to move together with the injection pipe 3 along the rack 10 for the purpose of engaging and disengaging the nose 5 of the injection pipe 3 relative to the head 2 of the burner. The injection pipe is shown in FIG. 3 in its operating position in solid lines $\mathbf{4}_a$, $\mathbf{3}_a$ and in its extractable position in dashed lines $\mathbf{4}_b$, $\mathbf{3}_b$. Another gear $\mathbf{9}_1$, or any endpiece, such as a square or a hexagon, suitable for engaging a driving wrench is situated at the other end of the shaft 8 that remains outside the duct 1, thereby enabling said shaft 8 to be rotated.

To keep the injection pipe 3 in the same plane while it is being moved along the direction XX' so that the gear $\mathbf{9}_2$ drives it uniformly along the rack 10, said injection pipe is secured to a lateral centering guide 11 that keeps it at a constant distance along the parallel walls of the sheath 6; this guide 11, or the bent portion 4 of the injection pipe 3, can be in abutment against a stop 30 disposed along said walls so as to maintain the longitudinal position of said pipe 3 inside the sheath 6, until the injection nose 5 situated at the end of the bent portion 4 of the injection pipe 3 is guided and properly positioned in the orifice 14 of the injection head, which in the example shown in the figures is a single central orifice disposed on the axis XX' of the burner.

Said burner head 2 also comprises a shutter 16 for shutting the end of the sheath 6 and opening out sideways on the axis XX' in the downstream direction of gas flow 27 in a ring shell $\mathbf{16}_1$ that is itself closed by a stabilizing plate 13 having orifices such as tangential slots or holes parallel to the axis XX', or inclined, through which outside air fed via said sheath 6 exits, and said orifice 14 for guiding the injection nose 5. An outer cylinder 12 surrounds at least said shell $\mathbf{16}_1$ and the stabilizing plate 13.

It should be observed that the feed of outside air inside said sheath 6 for the purpose of ensuring that the burner head 2 operates properly by contributing 3% to 10% of the oxygen stoichiometrically required for combustion, the remainder being provided by the gas 27 to be heated, also serves to cool said sheath 6 that extends transversely inside the duct 1 and encounters the gas 27 which may be at more than 500° C.

The area of the flow section for the gas 27 inside said cylinder 12 is equal to 20% to 50% of the section area of the duct 1 in which said burner is situated, said percentage being considered in proportion to the stoichiometric air content of the gas.

Figure 2:
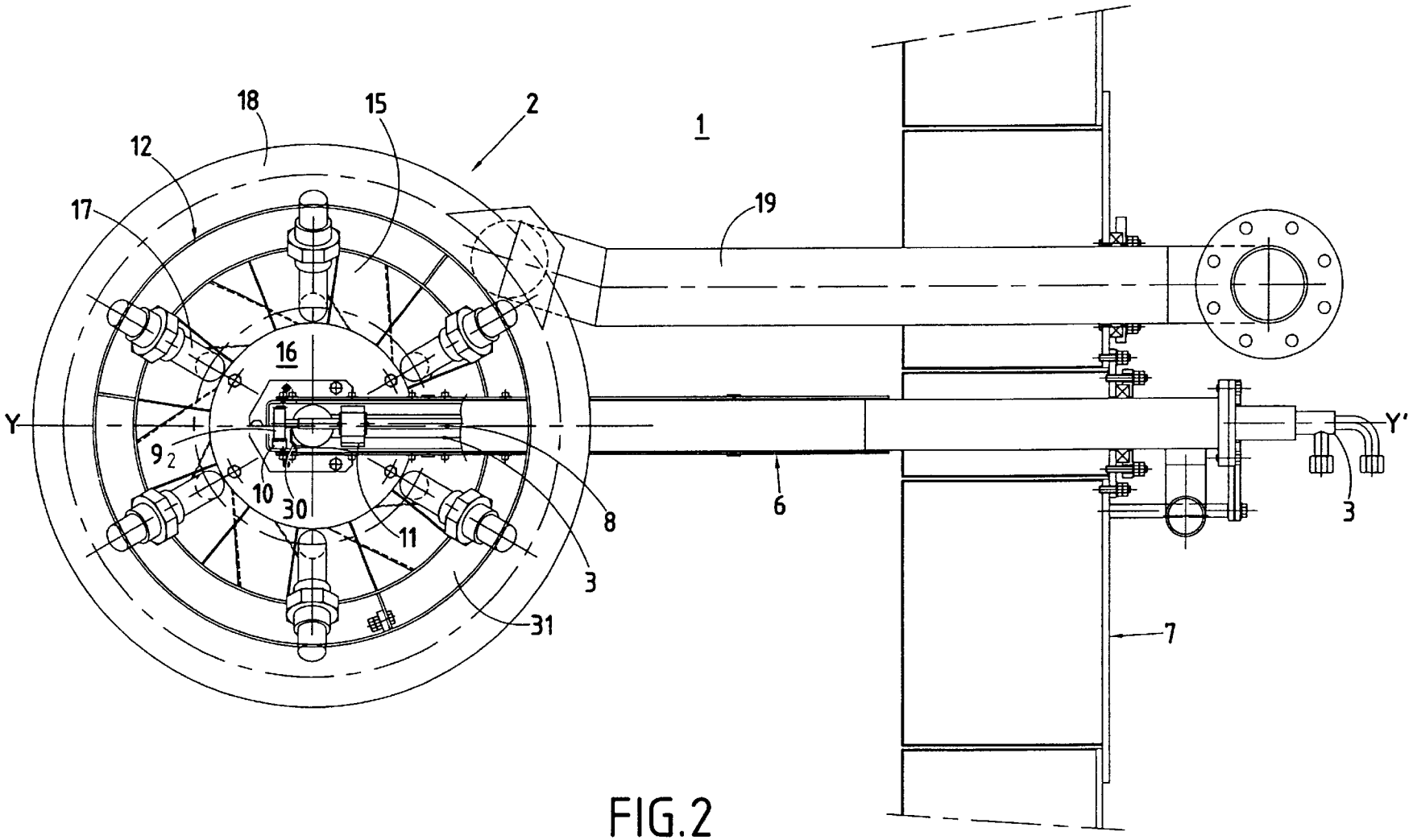
FIG. 2 is an enlarged view of the FIG. 1 burner on the same axis.

In the embodiment shown in FIGS. 2 and 3, said burner head 2 includes blades 15 for setting the gas into rotation, which blades are fixed around the air outlet shell $\mathbf{16}_1$ at the end of the sheath 6, and it includes gaseous fuel injection pipes 17 disposed through and between said blades 15 on axes parallel to that of the duct 1, or else converging or diverging.

Said inclined blades 15 may be surrounded by cylindrical banding 28 defining a peripheral ring 31 with the outer cylinder 12. Said outer cylinder 12 directs air that may optionally converge and diverge respectively at its upstream orifice $\mathbf{12}_1$ and at its downstream orifice $\mathbf{12}_2$. Said fuel gas injection pipes 17 pass through said sloping blades 15 injecting gas downstream from the plane of the front face of the stabilizing plate 13. The assembly constituted by said inclined blades 15, forming a rose, co-operates with the stabilizing plate 13 to constitute flame capture means as described in above-cited patent FR 2 570 473.

There may be any number of said gaseous fuel pipes 17, and in this case six are shown, all connected to at least one gas manifold 18 which may be in the form of a circularly symmetrical torus as shown in FIG. 3, and thus constituted by convergent upstream openings of said cylinder 12; said manifold 18 is connected to the outside via a fuel gas feed tube 19.

As shown in the figures, it is preferable for the axis YY' of the sheath 6 to extend perpendicularly to the axis XX' of the burner and of the duct 1, however it could be inclined at any other transverse angle preferably lying in the range 45° to 90° relative to the axis of said duct.

As shown in FIGS. 3 and 4, the device of the invention also includes at least two flaps 24 disposed on either side of the burner head 2, for tilting about axes 25 that are transverse relative to the axis of said duct 1 and of shapes that are compatible with the inside shape of the duct 1 and the outside shape of the burner head 2, serving in the closed position to reduce the gas flow section through at least the flow section of the burner head 2.

Said flaps 24 and their axes 25 are preferably hollow connected to a likewise hollow vertical duct 26; together these internal hollow parts can also be connected to the vertical hollow post 20 supporting the burner heads 2.

These means for internal fresh air circulation prevent the various parts constituting the device such as the extractable moving injection pipe 3 together with its various drive elements being damaged by overheating because of the cool air that passes along the sheath 6, and also along the hollow vertical post 20 supporting said burner heads and the set of moving flaps 24.

We claim:

1. A device for mounting a burner head inside a gas duct, said burner head having an upstream side and a downstream side, said duct having a gas flow axis comprising:

at least one fuel injection pipe having a first portion disposed transversely to said flow axis and a second portion disposed through the head of said burner along a central burner axis parallel to the axis of said duct, said second portion terminating with a nose;

a sheath secured to the upstream side of the burner head for feeding the burner with air from outside the duct, said sheath disposed transversely relative to the axis of said duct and enclosing said fuel injection pipe;

a guide orifice secured to said downstream side of the burner head for removably receiving therein the nose of the injection pipe wherein the injection pipe includes an associated rotary drive shaft driven alone a rack from outside the duct, said drive shaft extending parallel to the injection pipe and having a pair of ends, a distal end having a gear thereon which co-operates with said rack, said rack situated at a burner end of the sheath, wherein rotation of said gear and drive shaft moves the injection pipe along the rack to engage and disengage the nose of the injection pipe relative to the burner head.

2. The device according to claim 1, wherein the fuel injection pipe is removable from the duct from a position outside the duct.

3. The device according to claim 2, further including at least one hollow vertical post disposed inside said duct, said post having a top portion secured to said duct, said post supporting horizontally disposed running paths on which means for supporting and guiding said burner head are placed, said means facilitating removal of the burner head and sheath from the duct, from a position outside the duct.

4. The device according to claim 1, further including at least two flaps mounted on axes, each of which is disposed on either side of the burner head to tilt about said axes, which said axes extend transversely to said duct for reducing a gas flow cross section through a flow section of the burner head.

5. The device according to claim 4, wherein said flaps and said axes are hollow and are connected to a hollow vertical duct.

6. The device according to claim 1, further including a shutter for shutting an end of the sheath open to an inside of a ring shell, said ring shell closed by a stabilizing plate which includes air outlet orifices and said guide orifice for guiding the nose of said injection pipe, said device further including an outer cylinder surrounding at least said shell and the stabilizing plate.

7. The device according to claim 6, wherein a flow area inside said outer cylinder is equal to 20% to 50% of a cross sectional area of the duct.

8. The device according to claim 6, wherein said downstream side of the burner head includes blades for rotating the gas, the blades being fixed around the ring shell and around an air outlet at the end of the burner end of the sheath.

9. The device according to claim 1, wherein the sheath is disposed perpendicularly to the axis of the duct.

* * * * *